US010132284B2

(12) United States Patent
Mihnsung

(10) Patent No.: US 10,132,284 B2
(45) Date of Patent: Nov. 20, 2018

(54) IGNITION DEVICE FOR AN ISG-EQUIPPED VEHICLE USING LGP AS A FUEL

(71) Applicant: CONTINENTAL AUTOMOTIVE SYSTEMS CORPORATION, Gyeonggi-do (KR)

(72) Inventor: Kim Mihnsung, Icheon (KR)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 186 days.

(21) Appl. No.: 14/440,963

(22) PCT Filed: Feb. 14, 2014

(86) PCT No.: PCT/KR2014/001216
§ 371 (c)(1),
(2) Date: May 6, 2015

(87) PCT Pub. No.: WO2014/126409
PCT Pub. Date: Aug. 21, 2014

(65) Prior Publication Data

US 2015/0369198 A1 Dec. 24, 2015

(30) Foreign Application Priority Data

Feb. 14, 2013 (KR) ..... 10-2013-0015867

(51) Int. Cl.
*F02N 11/08* (2006.01)
*F02D 41/22* (2006.01)
(Continued)

(52) U.S. Cl.
CPC ..... *F02N 11/0803* (2013.01); *F02D 41/0027* (2013.01); *F02D 41/065* (2013.01);
(Continued)

(58) Field of Classification Search
CPC .. F02N 11/0803; F02N 11/04; F02N 11/0818; F02D 41/0027; F02D 41/0065;
(Continued)

(56) References Cited

U.S. PATENT DOCUMENTS 2,808,209 A 10/1957 Bressler
3,004,191 A * 10/1961 Umbarger ..... H05B 41/32 315/219
(Continued)

FOREIGN PATENT DOCUMENTS

JP 2006029142 A 2/2006 ..... B60R 16/02
JP 2007261289 A 10/2007 ..... B60S 5/02
(Continued)

OTHER PUBLICATIONS

International Search Report, Application No. PCT/KR2014/001216, 2 pages, dated May 14, 2014.
(Continued)

*Primary Examiner* — David Hamaoui
*Assistant Examiner* — Susan Scharpf
(74) *Attorney, Agent, or Firm* — Slayden Grubert Beard PLLC

(57) ABSTRACT

An ignition device is provided for an idle stop & go system (ISG)-equipped vehicle using a liquefied petroleum gas (LPG) as a fuel. A separately installed auxiliary LPG switch detects the ON/OFF state of the LPG switch, drives fuel cut-off solenoid valves, and switches on/off together with the LPG switch. The ON/OFF state of the LPG switch can be determined based on an output voltage of the auxiliary LPG switch, and then ISG control can be implemented. After the fuel cut-off solenoid valves are driven, the fuel pipeline pressure remains in the state before the idle stop to improve the engine starting performance upon restarting. Also, in an emergency, the LPG and auxiliary LPG switches are simul-
(Continued)

taneously switched off, the fuel cut-off solenoid valves are quickly switched off and the fuel pump motor is stopped to quickly cut off the fuel supply and prevent a secondary accident in advance.

4 Claims, 1 Drawing Sheet

(51) Int. Cl.

| | |
|---|---|
| ***F02D 41/00*** | (2006.01) |
| ***F02D 41/06*** | (2006.01) |
| ***F02P 9/00*** | (2006.01) |
| *F02D 41/04* | (2006.01) |
| *F02D 41/30* | (2006.01) |
| *F02N 11/04* | (2006.01) |

(52) U.S. Cl.
CPC ..... *F02D 41/22* (2013.01); *F02P 9/00* (2013.01); *F02D 41/042* (2013.01); *F02D 41/3082* (2013.01); *F02N 11/04* (2013.01); *F02N 11/0818* (2013.01)

(58) Field of Classification Search
CPC .... F02D 41/22; F02D 41/042; F02D 41/3082; F02P 9/00
USPC ..... 701/112; 123/478, 480, 481, 488, 490, 123/491, 575, 576, 198 DB
See application file for complete search history.

(56) References Cited

U.S. PATENT DOCUMENTS 4,453,506 A * 6/1984 Ueda ..... F02D 37/02 123/179.16
4,466,392 A * 8/1984 Uchida ..... F02N 11/0814 123/179.4
4,723,105 A * 2/1988 Matouka ..... H02J 7/1423 307/16
5,121,723 A 6/1992 Stepper et al. ..... 123/322
5,479,909 A * 1/1996 Blakeslee ..... H02J 7/1438 123/179.1
5,685,802 A * 11/1997 Kanno ..... F02B 75/20 290/40 C
5,937,829 A * 8/1999 Endou ..... F02D 41/3082 123/179.17
6,507,506 B1 * 1/2003 Pinas ..... B60L 11/1851 307/10.1
6,557,509 B1 * 5/2003 Hall ..... F02B 61/045 123/179.16
7,156,064 B2 * 1/2007 Namari ..... F02N 11/04 123/179.3
7,180,205 B2 * 2/2007 Wirdel ..... B60L 3/003 307/10.1
7,822,534 B2 * 10/2010 Matsubara ..... F01N 3/0807 123/198 DB
2007/0012284 A1 * 1/2007 Fukushima ..... F02D 41/009 123/333
2015/0152832 A1 * 6/2015 Desai ..... F02P 9/002 123/625
2015/0283964 A1 * 10/2015 Janarthanam ..... B60L 11/12 307/9.1

FOREIGN PATENT DOCUMENTS

| | | | | |
|---|---|---|---|---|
| JP | 2009068426 | A | 4/2009 | F02D 29/02 |
| KR | 1020050093956 | A | 9/2005 | F02D 41/22 |
| KR | 100819959 | B1 | 4/2008 | F02D 19/02 |
| KR | 1020110057472 | A | 6/2011 | B60R 25/045 |
| WO | 2014/126409 | A1 | 8/2014 | F02D 29/02 |

OTHER PUBLICATIONS

Korean Office Action, Application No. 2018047159337, 3 pages, dated Jul. 11, 2018.

* cited by examiner

[Fig. 1] (Prior Art)
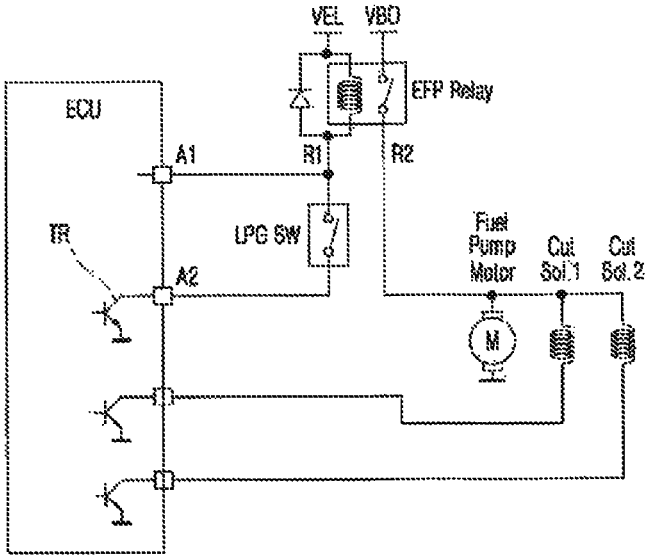
[Fig. 2]
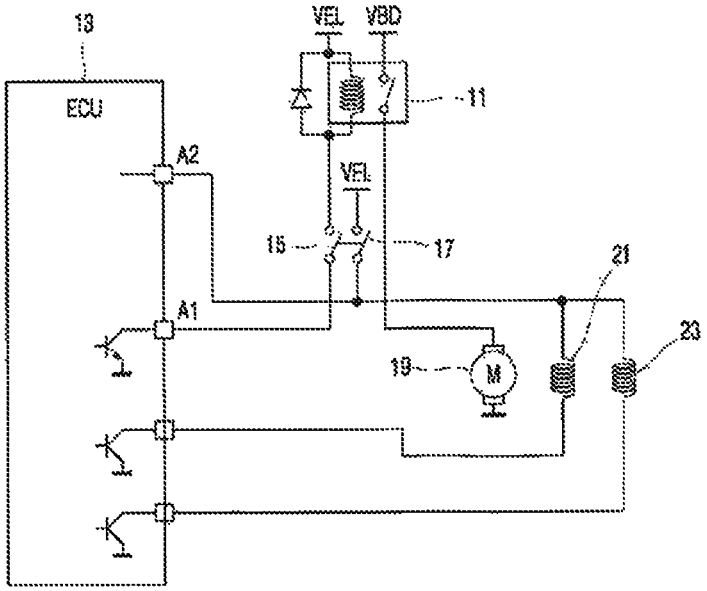

IGNITION DEVICE FOR AN ISG-EQUIPPED VEHICLE USING LGP AS A FUEL

CROSS-REFERENCE TO RELATED APPLICATIONS

This application is a U.S. National Stage Application of International Application No. PCT/KR2014/001216 filed Feb. 14, 2014, which designates the United States of America, and claims priority to KR Application No. 2013-0015867 filed Feb. 14, 2013, the contents of which are hereby incorporated by reference in their entirety.

TECHNICAL FIELD

The present invention relates to an ignition device for an ISG-equipped vehicle using LPG as a fuel, in particular an ignition device which senses the ON/OFF state of the LPG switch and implements ISG control according to the sensed state of the LPG switch.

BACKGROUND

The idle stop & go (ISG) system is equipped to reduce the fuel consumption and the emission of carbon dioxide. The ISG control means that the engine is automatically stopped after a vehicle is stopped (in the idle state) during running, and the engine can automatically be started without ignition when it is sensed that the driver is ready to drive.

In said vehicle ignition device which can implement ISG control, as shown in FIG. 1, the engine control unit (ECU) senses the ON/OFF state of the LPG switch (LPG SW) operated by the driver and drives the fuel pump motor according to the sensed ON/OFF state of the LPG SW of the engine to automatically start the engine.

Here, when the transistor (TR) used to start the driver in the ECU sensing the ON/OFF state of said LPG SW is shut off, said ECU is unable to sense the ON/OFF state of said LPG SW of said engine and thus continues to maintain the stop state of the engine.

Thus, to restart the engine, the starting motor (not shown in the drawings) of the ignition device keeps on running. This reduces the durability of the starting motor.

In addition, when said LPG SW is in the OFF state, the ECU is unable to diagnose the EFR relay which supplies power to the fuel pump motor.

SUMMARY

One embodiment provides an ignition device for an ISG-equipped vehicle using LPG as a fuel, wherein the ignition device comprises the following structures: a relay, which is installed in a specific position on a vehicle and provides the first external voltage for the fuel pump motor according to the ON/OFF state of the LPG SW; an auxiliary LPG SW, which can be switched on/off together with the LPG SW connected to the output port on one side of said relay, and provides the second external voltage for a plurality of fuel cut-off solenoid valves; and an ECU, which determines the ON/OFF state of said LPG SW on the basis of the supply of the second voltage of said relay according to the ON/OFF state of said LPG SW, and controls said LPG SW and said plurality of fuel cut-off solenoid valves according to the determined result of the ON/OFF state of the LPG SW to implement ISG control.

In a further embodiment, the second input port of the ECU is connected to the output port of said auxiliary LPG SW so that the ECU can receive the second voltage of said auxiliary LPG SW and sense the ON/OFF state of said LPG SW.

BRIEF DESCRIPTION OF THE DRAWINGS

Example embodiments of the invention are discussed in detail below with reference to the drawings, in which:

FIG. 1 shows the brief structure of a conventional ignition device for an ISG-equipped vehicle; and FIG. 2 shows the structure of the ignition device for an ISG-equipped vehicle in one embodiment of the present invention.

DETAILED DESCRIPTION

Embodiments of the present invention provide an ignition device for an ISG-equipped vehicle using LPG as a fuel. An auxiliary LPG SW is separately installed for the ignition device. Said auxiliary LPG SW can sense the ON/OFF state of the LPG SW, drive a plurality of fuel cut-off solenoid valves, and be switched on/off together with the LPG SW. Therefore, the ON/OFF state of said LPG switch can be determined according to the second output voltage of the auxiliary LPG SW, and then ISG control can be implemented. After the fuel cut-off solenoid valves are driven by the relay's second voltage output by auxiliary LPG SW, the fuel pressure in the fuel pipeline remains in the idle stop state to improve the starting performance of the engine at the time of restarting. In addition, in the case of an emergency, the LPG SW and the auxiliary LPG SW are simultaneously switched off, the fuel cut-off solenoid valves are quickly switched off and the fuel pump motor is also stopped so that the fuel supply can be cut off quickly and a secondary accident can be prevented in advance in an ISG-equipped vehicle using LPG as fuel.

Some embodiments provide an ignition device for an ISG-equipped vehicle using LPG as a fuel. Said device is wherein the following structures are included:

a relay, which is installed in a specific position on a vehicle and provides the first external voltage for the fuel pump motor according to the ON/OFF state of the LPG SW, an auxiliary LPG SW, which can be switched on/off together with the LPG SW connected to the output jack on one side of said relay, and provides the second external voltage for a plurality of fuel cut-off solenoid valves, and an ECU, which determines the ON/OFF state of said LPG SW on the basis of the supply of the second voltage of said relay according to the ON/OFF state of said LPG SW, and controls said LPG SW and said plurality of fuel cut-off solenoid valves according to the determination result of the ON/OFF state of the LPG SW to implement ISG control.

Here, the second input port of said ECU may be connected to the output port of said auxiliary LPG SW so that the ECU can sense the ON/OFF state of said LPG SW by receiving the second voltage of said auxiliary LPG SW.

Based on the output of the second voltage of the relay by the auxiliary LPG SW which can be switched on/off together with the LPG SW, the ECU senses the ON/OFF state of said LPG SW and controls said fuel pump motor and fuel cut-off solenoid valves according to the detected result of the ON/OFF state of the LPG SW to implement ISG control. Since the ECU can accurately sense the ON/OFF state of the LPG SW, it can successfully implement ISG control. In addition, according to the voltage output by the auxiliary LPG SW, a plurality of fuel cut-off solenoid valves can be driven so that the fuel pressure in the fuel pipeline remains in the state before the idle stop to improve the starting performance of the engine at the time of restarting.

FIG. 2 shows the structure of the ignition device for an ISG-equipped vehicle in an embodiment of the present invention.

As shown in FIG. 2, said device is separately installed with an auxiliary LPG SW which can be switched on/off together with the LPG SW and can drive a plurality of fuel cut-off solenoid valves according to the output voltage. The ignition device comprises a relay (11), an ECU (13), a LPG SW (15), an auxiliary LPG SW (17), a fuel pump motor (19), and a plurality of fuel cut-off solenoid valves (21 and 23).

Said relay (11), which provides the first external voltage (VBD) for the fuel pump motor (19) after said LPG SW (15) is switched on, usually comprises a relay coil, a relay switch, and a diode preventing reverse current. Since the structure of such a relay (11) is a well-known recognized technique, a detailed description of the structure of the relay is omitted here.

Said LPG SW (15) is connected to the output port on one side of said relay (11). When the LPG SW (15) is switched on, it provides the second voltage (VEL) output by said relay (11) for said ECU (13) through the first input port (A1).

In addition, said auxiliary LPG SW (17) is switched on/off together with said LPG SW (15) and the second voltage (VEL) output by said auxiliary LPG SW (17) is provided for the ECU (13) through the second input port (A2).

In addition, after receiving the supply of the first voltage (VBD) of said relay (11), said fuel pump motor (19) is driven to increase the fuel pressure in the fuel pipeline to restart the engine.

In addition, said plurality of fuel cut-off solenoid valves (21 and 23) are driven by the relay's (11) second voltage (VEL) output by said auxiliary LPG SW (17). Therefore, in the case of an idle stop or emergency, the fuel supply in the pipeline can quickly be cut off so that the fuel pressure in the pipeline remains in the state before the idle stop.

Said ECU (13) determines the ON/OFF state of the LPG SW (15) according to the second voltage (VEL) output by said auxiliary LPG SW (17), controls the fuel pump motor (19) and the plurality of fuel cut-off solenoid valves (21 and 23) according to the determined result, and thus implements ISG control according to the ON/OFF state of said LPG SW (15).

Here, the ISG implementation process is a recognized technique known to those skilled in the relevant art, and therefore, the specific structure and working process are omitted.

According to such a structure, when the driver switches on the LPG SW (15), the first voltage (VBD) of said relay (11) is provided for said fuel pump motor (19).

Said fuel pump motor (19) is driven by the first voltage (VBD) of said relay (11), and then the fuel in the fuel tank (not shown in the drawings) is provided for the fuel injector (not shown in the drawings) along the fuel pipeline.

After the LPG SW (15) is switched on, the second voltage (VEL) output by said relay (11) is provided for the ECU (13) through the first input port (A1).

At this time, when said LPG SW (15) is switched on, said auxiliary LPG SW (17) is also switched on and the second voltage (VEL) output by said auxiliary LPG SW (17) is provided for the ECU (13) through the second input port (A2).

Then, after receiving the second voltage of the auxiliary LPG SW (17), the ECU (13) determines the ON/OFF state of the LPG SW (15) and controls the fuel pump motor (19) and the fuel cut-off solenoid valves (21 and 23) according to the determined result to implement ISG control.

That is, in an idle stop state, the ECU (13) determines that the LPG SW (15) is switched off and the drive of the relay (11) is stopped, and then the first voltage (VBD) output by the relay (11) is cut off, and said fuel pump motor (19) also stops working.

At this time, when said LPG SW (15) is switched off, said auxiliary LPG SW (17) is also switched off, the second voltage (VEL) output by said auxiliary LPG SW (17) quickly drives to switch off the plurality of fuel cut-off solenoid valves (21 and 23), and then the fuel supply in the fuel pipeline is quickly stopped. That is, the fuel pressure in the fuel pipeline remains in the state before an idle stop.

After that, in the case of idle stop & go, said ECU (13) switches on the LPG SW (15), and the first voltage (VBD) of the relay (11) drives the fuel pump motor (19) to increase the fuel pressure in the fuel pipeline.

At this time, the fuel pressure in the fuel pipeline remains in the state before an idle stop and increases quickly, with the time it takes to reach the targeted fuel pressure shortened to the minimal.

In addition, after the driver switches off the LPG SW (15) by force in the case of an emergency, the auxiliary LPG SW (17) is also switched off and the fuel pump motor (19) and the fuel cut-off solenoid valves (21 and 23) are also driven to be switched off.

An auxiliary LPG switch is separately installed. Said auxiliary LPG switch can sense the ON/OFF state of the LPG switch, drive a plurality of fuel cut-off solenoid valves, and be switched on/off together with said LPG switch. Therefore, the ON/OFF state of said LPG switch can be determined according to the second output voltage of the auxiliary LPG SW, and then ISG control can be implemented. After the fuel cut-off solenoid valves are driven by the relay's second voltage output by the auxiliary LPG SW, the fuel pressure in the fuel pipeline remains in the state before the idle stop to improve the starting performance of the engine at the time of restarting. In addition, in the case of an emergency, the LPG SW and the auxiliary LPG SW are simultaneously switched off, the fuel cut-off solenoid valves are quickly switched off and the fuel pump motor is also stopped so that the fuel supply can be cut off quickly and a secondary accident can be prevented in advance.

As discussed above, the auxiliary LPG SW can sense the ON/OFF state of the LPG SW, drive a plurality of fuel cut-off solenoid valves, and be switched on/off together with the LPG SW. Therefore, the ON/OFF state of said LPG SW can be determined according to the ON/OFF state of the auxiliary LPG SW, and then ISG control can be implemented. After the fuel cut-off solenoid valves are driven by the external voltage output by the auxiliary LPG SW, the fuel pressure in the fuel pipeline remains in the state before the idle stop to improve the starting performance of the engine at the time of restarting. In addition, in the case of an emergency, the LPG SW and the auxiliary LPG SW are simultaneously switched off, the fuel cut-off solenoid valves are quickly switched off and the fuel pump motor is also stopped so that the fuel supply can be cut off quickly and a secondary accident can be prevented in advance. Embodiments of the present invention may improve the operation accuracy and reliability of the above-mentioned ignition device for an ISG-equipped vehicle, as well as the performance and the efficiency.

What is claimed is:

1. An ignition device for an idle stop & go (ISG) equipped vehicle using liquefied petroleum gas (LPG) as a fuel, wherein the ignition device comprises:

an LPG switch with an ON/OFF state set by an operator of the vehicle to either ON or OFF, a plurality of fuel cut-off solenoid valves, a relay providing a first external voltage for the fuel pump motor from the output of the LPG switch, an auxiliary LPG switch configured to be in the same ON/OFF state as the LPG switch, wherein the auxiliary LPG switch provides a second external voltage from the output of the auxiliary LPG switch to the plurality of fuel cut-off solenoid valves, and an ECU configured to:

sense the output of the auxiliary LPG switch to determine the ON/OFF state of the LPG switch, and control the fuel pump motor and the plurality of fuel cut-off solenoid valves based on the determined ON/OFF state of the LPG switch to implement ISG control.

2. The ignition device of claim 1, wherein an input port of the ECU is connected to an output port of the auxiliary LPG switch to provide a connection for the ECU to receive the second voltage of the auxiliary LPG switch and determine the ON/OFF state of the LPG switch.

3. An idle stop & go (ISG) equipped vehicle using liquefied petroleum gas (LPG) as a fuel, the vehicle including an ignition device comprising:

an LPG switch with an ON/OFF state set by an operator of the vehicle to either ON or OFF, a plurality of fuel cut-off solenoid valves, a relay providing a first external voltage for the fuel pump motor from the output of the LPG switch, an auxiliary LPG switch configured to be in the same ON/OFF state as the LPG switch, wherein the auxiliary LPG switch provides a second external voltage from the output of the auxiliary LPG switch to the plurality of fuel cut-off solenoid valves, and an ECU configured to:

sense the output of the auxiliary LPG switch to determine the ON/OFF state of the LPG switch, and control the fuel pump motor and the plurality of fuel cut-off solenoid valves based on the determined ON/OFF state of the LPG switch to implement ISG control.

4. The ISG-equipped vehicle of claim 3, wherein an input port of the ECU is connected to an output port of the auxiliary LPG switch to provide a connection for the ECU to receive the second voltage of the auxiliary LPG switch and determine the ON/OFF state of the LPG switch.

* * * * *